US005694156A

United States Patent [19]

Hoisington et al.

[11] Patent Number: 5,694,156

[45] Date of Patent: Dec. 2, 1997

[54] INK JET HEAD WITH INK USAGE SENSOR

[75] Inventors: Paul A. Hoisington, Norwich; Nathan P. Hine, South Strafford, both of Vt.

[73] Assignee: Spectra Inc., Keene, N.H.

[21] Appl. No.: 143,166

[22] Filed: Oct. 26, 1993

Related U.S. Application Data

[63] Continuation-in-part of Ser. No. 615,893, Nov. 20, 1990, Pat. No. 5,265,315.

[51] Int. Cl.[6] ..... B41J 2/195; B41J 29/38

[52] U.S. Cl. ..... 347/7; 347/5; 347/88

[58] Field of Search ..... 347/5, 7, 88, 49, 347/14, 85–87; 355/201

[56] References Cited

U.S. PATENT DOCUMENTS

| | | | |
|---|---|---|---|
| 4,121,222 | 10/1978 | Diebold et al. . | |
| 4,937,598 | 6/1990 | Hine et al. | 347/7 |
| 5,049,898 | 9/1991 | Arthur et al. | 347/19 |
| 5,068,806 | 11/1991 | Gatten . | |
| 5,189,442 | 2/1993 | Herbert | 347/88 |
| 5,235,351 | 8/1993 | Koizumi | 347/14 |
| 5,265,315 | 11/1993 | Hoisington et al. | 29/25.35 |

FOREIGN PATENT DOCUMENTS

| | | | |
|---|---|---|---|
| 0426692 | 2/1993 | European Pat. Off. . | |
| 60-187126 | 9/1985 | Japan | 340/653 |
| 63-121856 | 5/1988 | Japan | 355/201 |
| 4-141442 | 5/1992 | Japan | 347/7 |
| 4-144754 | 5/1992 | Japan | 347/7 |
| WO9218335 | 3/1992 | WIPO . | |

*Primary Examiner*—Benjamin R. Fuller
*Assistant Examiner*—Craig A. Hallacher
*Attorney, Agent, or Firm*—Brumbaugh, Graves, Donohue & Raymond

[57] ABSTRACT

In the representative embodiments disclosed in the specification, an ink jet system includes a carriage for driving an ink jet head having a reservoir containing ink in a reciprocating motion and a counter for counting ink drops ejected through orifices in the ink jet head, and a nonvolatile memory for storing a number corresponding to the number of drops ejected and for generating a signal to terminate operation of the head or to produce a warning signal or to permit completion of printing of a sheet being printed when the number in the memory reaches a selected value. The ink jet head, which is removable from the system, has a refillable reservoir and, to prevent unauthorized refilling, a security arrangement utilizing a special code or a fuse is provided.

13 Claims, 2 Drawing Sheets

INK JET HEAD WITH INK USAGE SENSOR

REFERENCE TO RELATED APPLICATION

This application is a continuation-in-part of the Hoisington et al. application Ser. No. 07/615,893 filed Nov. 20, 1990, now U.S. Pat. No. 5,265,315.

BACKGROUND OF THE INVENTION

This invention relates to ink jet systems and, more particularly, to a new and improved ink jet head with an ink usage sensor for use in an ink jet system.

Conventional ink jet systems have an ink jet head containing an ink reservoir in which a low ink level is detected by a sensor to initiate replenishment of the ink in the head reservoir from a remote supply connected to the head. Certain ink jet systems provide an ink jet head which is replaceable and is intended to be replaced when the ink supply in the reservoir is exhausted. In such heads, a low-ink sensor will terminate operation of the head or else provide a warning signal to the operator, indicating that the ink supply is low. If the head merely stops printing when a low level is detected, it may stop in the middle of a page of text, requiring the page to be started over again when the head has been replaced. If the head is permitted to continue printing, the ink may run out during continued printing before the head has been replaced, which could also require part of a page of text to be reprinted.

Another form of low-ink detector, described, for example, in the Gatten U.S. Pat. No. 5,068,806, detects the number of ink drops ejected by the ink jet head and, when the number of drops corresponding to the nominal capacity of the ink reservoir has been ejected, a message is printed by the printer advising the operator to provide a new ink supply, after which the ink-drop counter is reset by the operator. In the ink jet system described in that patent, however, the number of drops ejected is counted and retained by a memory in the system control computer, so that the remaining ink information is lost if an ink jet head or ink cartridge is moved from one ink jet system to another.

Moreover, if the reservoir in a hot melt ink jet head in which residual ink has solidified is refilled with a fixed quantity of hot melt ink, cumulative errors resulting from variations in the amount of hot melt ink left at the time of refill can cause overfilling of the reservoir or permit the reservoir to run dry if a fixed number of drops is used as the basis for determining when the head should be replaced.

European Patent No. 0 426 692 discloses an ink jet printer system supplied with ink from a nonreusable reservoir containing ink retained in balloons. To avoid refilling and reuse of the reservoir, which could result in overfilling or running dry as discussed above, the reservoir of this patent contains a fuse which is blown to break an electrical circuit, preventing further use when the ink in the reservoir falls below a selected value.

SUMMARY OF THE INVENTION

Accordingly, it is an object of the present invention to provide a new and improved ink jet head with an ink usage sensor which overcomes the disadvantages of the prior art.

Another object of the invention is to provide an ink jet head with an ink usage sensor which prevents lost images when the printhead reservoir runs low on ink and which can be refilled and reused without cumulative errors in the quantity of ink contained in the reservoir.

A further object of the invention is to provide a replaceable hot melt ink jet head with a refillable reservoir.

These and other objects of the invention are attained by providing an ink jet head having an ink reservoir along with a nonvolatile memory and an ejected ink-drop counter and a counter control arrangement to initiate drop counting only when the reservoir has been filled by an appropriate source at which the quantity of ink in the reservoir can be determined accurately.

In one embodiment, the ink jet head is supplied with a nonvolatile memory and a counter for counting ejected ink drops, both of which are incorporated in the structure of the ink jet head, and the nonvolatile memory requires a special code for resetting. In another embodiment, the ink jet head is provided with a fuse which is inserted in the head when properly filled or refilled and a counter associated with the operation of the ink jet head is reset when the fuse is detected and, in turn, blows the fuse when use of the head is initiated.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
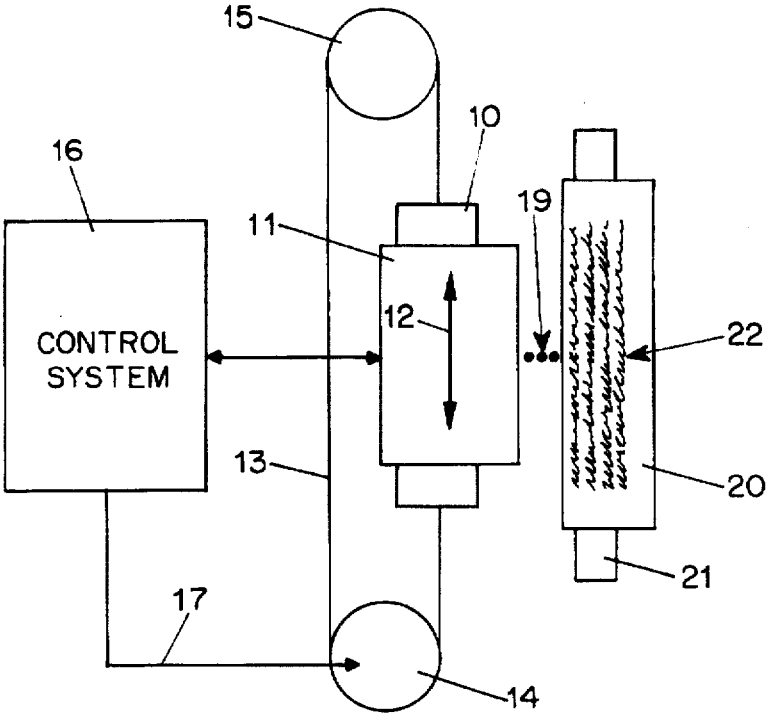
FIG. 1 is a schematic plan view showing a representative embodiment of an ink jet system containing an ink jet head in accordance with the invention.
Figure 2:
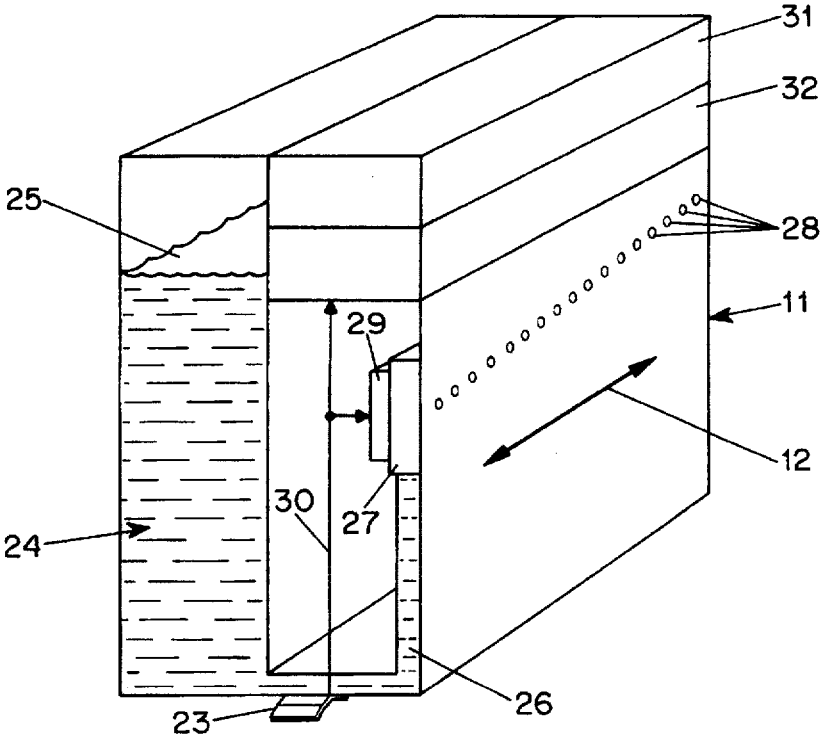
FIG. 2 is a schematic perspective view illustrating the arrangement of a representative embodiment of an ink jet head having an ink usage sensor in accordance with the invention.
Figure 3:
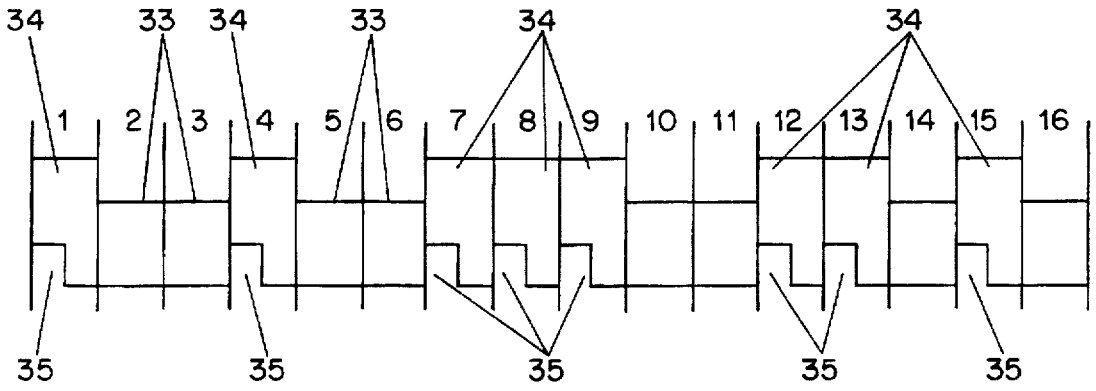
FIG. 3 is a graphical representation showing the signals generated by the control unit for the ink jet head of FIGS. 1 and 2 and a related ink usage sensor.

In the typical embodiment of the invention shown in FIGS. 1–3, a carriage 10 carrying an ink jet head 11 is moved in a reciprocating path indicated by the arrow 12 by a belt 13 which is driven by a drive motor 14 and is carried over a spindle 15 at the opposite end of the path. A control system 16 supplies signals through a line 17 to the drive motor 14 and also supplies signals through a cable 18 to the ink jet head 11 to control the ejection of ink drops 19 from the head toward a closely adjacent substrate 20. The substrate 20 is driven by a drive roll 21 in a direction perpendicular to the direction of reciprocating motion of the ink jet head and the ink ejection control signals and the substrate drive signals are arranged so that the ink ejected from the head produces an image 22 on the substrate 20.

The ink jet head 11 is connected to lines in the cable 18 by a series of contacts 23, one of which is shown in FIG. 2, which engage corresponding contacts (not shown) in the carriage 10. An ink reservoir 24 in the ink jet head 11 contains a supply of ink 25 which flows through a series of conduits 26 to a corresponding series of pressure chambers 27. If hot melt ink is used in the head, appropriate heaters (not shown) are arranged to heat the ink and maintain it in a molten condition during operation, but permit the ink to be solidified when the system is not in use. Each of the pressure chambers 27 is associated in the conventional manner with one of a series of orifices 28 through which ink is ejected when a pressure chamber transducer 29 receives an appropriate signal on a line 30 connected to the contact 23.

In the illustrated embodiment shown in FIG. 2, the series of orifices 28 is arranged in a line disposed at an angle to the direction of reciprocating motion 12 of the head so that, during each pass of the head adjacent to the substrate 20, printing is effected by ink ejected from selected orifices 28 to produce dots at appropriate places in a path consisting of a series of adjacent lines on the substrate 20, after which the substrate is advanced by the drive roll 21 by a distance equal to the width of that path.

In accordance with the invention, the embodiment of the ink jet head shown in FIG. 2 includes a nonvolatile memory 31 and a pulse counter 32 which counts a series of pulses corresponding to the pulses supplied on the line 30 to cause ejection of ink drops through the orifices 28. Preferably, the nonvolatile memory 31 is preset at the time the reservoir 24 is filled with ink 25 at the factory with a number corresponding to the total number of drops intended to be ejected before the ink 25 in the reservoir 24 should be replenished, while leaving a predetermined quantity of ink to permit completion of, for example, one page of text, without using all of the ink in the reservoir.

During operation, the pulse counter 32 supplies pulses to the memory 31 to deduct the total number of ink drops ejected from the head from the number retained in the memory and, when the number in the memory 31 reaches zero, a signal is provided by the memory to initiate appropriate action. Such appropriate action may, for example, include immediate termination of printing, or transmittal of a warning signal to the control unit 16, or setting of a latch which will prohibit feeding of another sheet of substrate 20 into the printer after completion of the printing of the sheet then being printed.

FIG. 3 illustrates the manner in which the usage counter responds to the signals supplied on the line 30 so as to control the number retained in the nonvolatile memory. In the example shown in FIG. 3, a series of transducer control signals to be supplied to a series of 16 orifices is indicated by low and high signal levels 33 and 34, the high signal levels 34 representing transducer actuation. Each high-level control signal 34 initiates a corresponding usage counter control signal 35 which is detected by the counter 32 and transmitted to the nonvolatile memory 31 to be deducted from the number retained in the memory.

After the number in the nonvolatile memory 31 has been reduced to zero and any additional printing has been completed, the replaceable ink jet head 11 is removed from the carriage 10 and replaced by another ink jet head with a factory-filled reservoir 24. The used ink jet head may then be discarded or returned to a factory for refilling. If hot melt ink is used in the head, the total quantity of ink remaining in the head can be determined, for example, by weighing the head. The reservoir 24 is then replenished to provide a quantity of ink equal to the original quantity of ink and the nonvolatile memory 31 is reset at the factory to the original count. To prevent unauthorized replenishment of the reservoir, which could lead to cumulative errors in the counting of ink drops, a special code is required to reset the nonvolatile memory.

In the embodiment of the invention described with reference to FIGS. 1–3, the ink jet head 11 includes an integral counter 32 and nonvolatile memory 31 in which a number corresponding to the remaining quantity of ink in the reservoir is stored. Consequently, the head can be removed from the carriage 10 and stored or moved to another ink jet printer without losing information regarding the quantity of ink remaining in the reservoir. In an alternative embodiment shown in FIG. 4, protection against unauthorized refilling of an ink jet head 36 is provided by incorporating a fuse 37 in the head. In this case, the control system 16, which is similar to the control system 16 shown in FIG. 1, includes a system control unit 38, a carriage drive 39, and a printing control unit 40, from which signals are supplied to the ink jet head through a line 18 to control ejection of ink drops. In this embodiment, however, the printing control unit 40 includes a counter 41 and a nonvolatile memory 42 for counting and retaining information about the number of drops ejected by the ink jet head, thereby reducing the cost and weight of the ink jet head 36 in comparison with the ink jet head 11.

Figure 4:
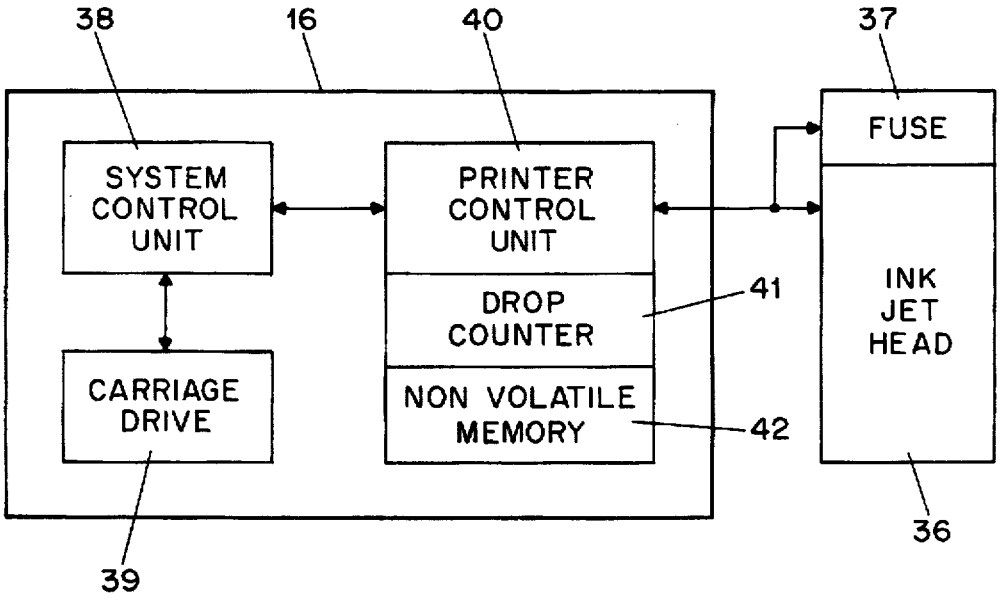
FIG. 4 is a schematic block diagram showing the arrangement of another representative embodiment of the invention.

Whenever printing is initiated with the embodiment shown in FIG. 4, the printing control unit 40 senses for the presence of a fuse 37 in the ink jet head 36 and, if the fuse is detected, the memory 42 is reset to a number corresponding to the full capacity of the ink reservoir in the ink jet head and the fuse 37 is blown. During operation, the counter 41 counts the number of drops ejected by the ink jet head and deducts that number from the number stored in the memory 42 and thereafter, whenever printing is initiated, the control unit 40 senses the absence of a fuse in the head 36 and does not reset the memory 42. When the total number of drops ejected by the ink jet head reaches the number initially stored in the memory 42, the same action described above with respect to the head 11 is taken, i.e., the printing may be stopped immediately or a warning signal may be provided to the operator to replace the head or printing may continue until an appropriate time such as completion of the page then being printed, and then the printing operation is stopped until the head has been replaced.

If the ink jet head 11 utilizes a polarizable material such as lead-zirconium-titanate (PZT) in the transducer which is actuated to eject drops of ink, the fuse 37 may conveniently consist of a selected portion of the transducer material in which a pattern of polarized and nonpolarized areas is stored when the reservoir in the ink jet head is filled. When the head is installed, the system detects the presence of the polarized pattern and, after resetting the counter, depolarizes the polarized portions of the pattern.

Although the invention has been described herein with reference to specific embodiments, many modifications and variations therein will readily occur to those skilled in the art. Accordingly, all such variations and modifications are included within the intended scope of the invention.

We claim:

1. An ink jet system comprising ink jet head means for jetting ink including an ink supply, an array of orifices, transducer means for causing selective ejection of ink drops through the orifices, counter means for counting the drops ejected through the orifices, nonvolatile memory means including means for storing a number corresponding to the number of drops ejected through the orifices in the ink jet head means and to indicate appropriate action when the number of drops exceeds a selected number and reset means for resetting the nonvolatile memory means upon replenishment of the ink supply.

2. An ink jet system according to claim 1 further comprising support means for supporting the ink jet head means and a substrate for relative motion between the ink jet head means and the substrate so as to produce an image on the substrate during operation of the system, an ink reservoir in the ink jet heat means, and control means including means for causing relative motion between the ink jet head means and the substrate and means for supplying control signals to the transducer means to cause ejection of ink through the array of orifices, wherein the ink jet head means is removably mounted on the support means and wherein the means for storing a number corresponding to the number of drops ejected through the orifices in the ink jet head means permits removal of the ink jet head means from the system without loss of ink usage information.

3. An ink jet system according to claim 2 including counter control means arranged to initiate counting by the counter means only when a security arrangement has been activated.

4. An ink jet system according to claim 3 wherein the counter means is included in the ink jet head means and the security arrangement includes means for setting the non-volatile memory means using a special code.

5. An ink jet system according to claim 2 wherein the control means is arranged to permit completion of printing of a substrate following detection of the signal indicating the predetermined number in the nonvolatile memory.

6. An ink jet system according to claim 2 wherein the support means supports the ink jet head for motion during ejection of ink from the orifices in the ink jet head means.

7. An ink jet system according to claim 2 wherein the ink jet head is removably supported on the support means to permit replacement of the ink jet head means.

8. An ink jet head for use in an ink jet system comprising an ink supply, an array of orifices, transducer means for causing selective ejection of ink drops through the orifices in response to control signals, counter means for counting the drops ejected through the orifices in the array, nonvolatile memory means including means for storing a number corresponding to the number of drops ejected through the orifices in the array and reset means for resetting the non-volatile memory means upon replenishment of the ink supply.

9. An ink jet head according to claim 8 wherein the ink jet head is adapted to be removably mounted on a support, and further comprising a refillable ink reservoir, a supply of hot melt ink in the reservoir, wherein the nonvolatile memory permits removal of the ink jet head from an ink jet system without loss of information stored in the memory, and wherein the counter means supplies ink usage information to the nonvolatile memory.

10. An ink jet system comprising support means for supporting an ink jet head and a substrate for relative motion between the ink jet head and the substrate so as to produce an image on the substrate during operation of the system, ink jet head means for jetting ink including an ink reservoir, an array of orifices and transducer means for causing selective ejection of ink drops through the orifices in response to control signals, control means including means for causing relative motion between the ink jet head means and the substrate and means for supplying control signals to the transducer means to cause ejection of ink through the array of orifices, counter means for counting the drops ejected through the orifices, nonvolatile memory means including means for storing a number corresponding to the number of drops ejected through the orifices in the ink jet head means and means for producing a signal to indicate appropriate action when the number of drops ejected through the orifices reaches or exceeds a predetermined number, and counter control means arranged to initiate counting by the counter means only when a security arrangement has been activated, wherein the security means includes a resettable polarizable element in the ink jet head means and means for setting a selected polarization condition of the polarizable element in response to replenishment of ink in the ink reservoir and wherein the counter means and nonvolatile memory means are included in the control means and wherein the control means includes means for resetting the nonvolatile memory means in response to detection of the polarizable element in the ink jet head means and for altering the polarization condition of the polarizable element when the nonvolatile memory means is reset.

11. An ink jet system according to claim 10 wherein the polarizable element is a portion of the transducer means used for ejection of drops from the ink jet head means.

12. An ink jet head for use in a hot melt ink jet system adapted to be removably mounted on a support, comprising a refillable ink jet head including an ink reservoir, a supply of hot melt ink in the reservoir, an array of orifices and transducer means for causing selective ejection of hot melt ink through the orifices in response to control signals, including a resettable polarizable element in the ink jet head and means for setting a selected polarization condition in the polarizable element for indicating a full status of the hot melt ink supply in the reservoir.

13. An ink jet head according to claim 12 wherein the polarizable element is a portion of the transducer means for causing selective ejection of hot melt ink through the orifices in response to control signals.

* * * * *